US006687962B2

(12) United States Patent
Clarner et al.

(10) Patent No.: US 6,687,962 B2
(45) Date of Patent: Feb. 10, 2004

(54) FASTENER ELEMENT PATTERNING

(75) Inventors: Mark A. Clarner, Concord, NH (US); Michelle M. Ennis, Manchester, NH (US); Michael J. Carbonneau, Bedford, NH (US)

(73) Assignee: Velcro Industries B.V., Curacao (AN)

( * ) Notice: Subject to any disclaimer, the term of this patent is extended or adjusted under 35 U.S.C. 154(b) by 0 days.

(21) Appl. No.: 10/050,669

(22) Filed: Jan. 16, 2002

(65) Prior Publication Data

US 2003/0131453 A1 Jul. 17, 2003

(51) Int. Cl.[7] ..... A44B 18/00

(52) U.S. Cl. ..... 24/452; 24/442

(58) Field of Search ..... 24/306, 442, 450, 24/452, 444, 451; 428/99, 100

(56) References Cited

U.S. PATENT DOCUMENTS

| | | | |
|---|---|---|---|
| 3,076,244 | A | 2/1963 | DeMestral |
| 3,101,517 | A | 8/1963 | Fox |
| 3,191,255 | A | 6/1965 | Nealis |
| 3,266,113 | A | 8/1966 | Flanagan, Jr. |
| 3,312,583 | A | 4/1967 | Rochlis |
| 3,320,649 | A | 5/1967 | Naimer |
| 3,405,430 | A | 10/1968 | Sidelman |
| 3,408,705 | A | 11/1968 | Kayser et al. |
| 3,522,637 | A | 8/1970 | Brumlik |
| 3,526,867 | A | 9/1970 | Keeler |
| 3,557,413 | A | 1/1971 | Engle |
| 3,629,930 | A | 12/1971 | Brumlik |
| 3,686,718 | A | 8/1972 | Brumlik |
| 3,710,425 | A | 1/1973 | Brumlik |
| 3,808,646 | A | 5/1974 | Brumlik |
| 3,808,648 | A | 5/1974 | Billarant et al. |

(List continued on next page.)

FOREIGN PATENT DOCUMENTS

| | | |
|---|---|---|
| EP | 0138724 | 9/1984 |
| EP | 0418951 | 3/1991 |
| EP | 0549705 | 7/1993 |
| EP | 0565750 | 10/1993 |
| EP | 0619085 | 10/1994 |
| EP | 0852918 | 7/1998 |
| EP | 0894448 | 2/1999 |
| GB | 2279106 | 12/1994 |
| JP | 5-199911 | 8/1993 |
| JP | 7-143905 | 6/1995 |
| JP | 7-184708 | 7/1995 |
| JP | 9-94109 | 4/1997 |
| JP | 9-252811 | 9/1997 |
| JP | 2000-94109 | 4/2001 |
| WO | 97/13981 | 4/1997 |
| WO | 97/31549 | 9/1997 |
| WO | 98/25495 | 6/1998 |
| WO | 98/30381 | 7/1998 |
| WO | 98/35576 | 8/1998 |
| WO | 98/57565 | 12/1998 |
| WO | 00/00053 | 1/2000 |
| WO | 00/05989 | 2/2000 |
| WO | 00/19938 | 4/2000 |
| WO | 00/40110 | 7/2000 |
| WO | 0050229 A | 8/2000 |
| WO | 00/60974 | 10/2000 |
| WO | 00/64296 | 11/2000 |

*Primary Examiner*—Robert J. Sandy
(74) *Attorney, Agent, or Firm*—Fish & Richardson P.C.

(57) ABSTRACT

A touch fastener product for releasable engagement with itself or another fastener product at various engagement angles, has a sheet-form base and an array of fastener elements with stems integrally molded with and extending from a broad side of the base to a distal head overhanging the base. The fastener elements are arranged in various ordered patterns of straight rows, with the heads of the fastener elements covering the base at a desired head density. The fastener elements define a sufficient number and pattern of pockets between associated groups of adjacent stems to provide a desired bulk locking ratio when engaged with an identical pattern at a zero degree engagement angle.

73 Claims, 5 Drawing Sheets

U.S. PATENT DOCUMENTS 3,833,972 A 9/1974 Brumlik
3,840,945 A 10/1974 Brumlik
3,869,764 A 3/1975 Umezu
3,879,835 A 4/1975 Brumlik
3,889,322 A 6/1975 Brumlik
3,899,803 A 8/1975 Brumlik
3,913,183 A 10/1975 Brumlik
3,921,259 A 11/1975 Brumlik
3,981,051 A 9/1976 Brumlik
4,001,366 A 1/1977 Brumlik
4,180,890 A 1/1980 Brumlik
4,198,734 A 4/1980 Brumlik
4,216,257 A 8/1980 Schams et al.
4,290,174 A 9/1981 Kalleberg
4,290,832 A 9/1981 Kalleberg
4,322,875 A 4/1982 Brown et al.
4,819,309 A 4/1989 Behymer
4,875,259 A 10/1989 Appledom
4,887,339 A 12/1989 Bellanger
4,944,072 A 7/1990 Robson
5,040,275 A 8/1991 Eckhardt et al.
5,067,210 A 11/1991 Keyaki
5,077,870 A 1/1992 Melbye et al.
5,196,266 A 3/1993 Lu et al.
5,212,853 A 5/1993 Yoshio
5,212,855 A 5/1993 McGanty
5,235,731 A 8/1993 Anzal et al.
5,242,646 A 9/1993 Torigoe et al.
5,396,687 A 3/1995 Osterman
5,457,855 A 10/1995 Kenney et al.
5,473,800 A 12/1995 Hatomoto et al.
5,490,808 A 2/1996 Jantschek et al.
5,579,562 A 12/1996 Hattori et al.
5,596,794 A * 1/1997 Shibanushi ..... 24/452
5,607,635 A 3/1997 Melbye et al.
5,611,122 A 3/1997 Torigoe et al.
5,614,232 A 3/1997 Torigoe et al.
5,625,929 A 5/1997 Hattori et al.
5,634,245 A 6/1997 Rouser et al.
5,639,327 A 6/1997 Mody et al.
5,657,516 A 8/1997 Berg et al.
5,671,511 A 9/1997 Hattori et al.
5,671,512 A 9/1997 Hattori et al.
5,679,302 A 10/1997 Miller et al.
5,691,021 A 11/1997 Kobe
5,713,111 A 2/1998 Hattori et al.
5,761,775 A 6/1998 Legome et al.
5,797,170 A 8/1998 Akeno
5,799,378 A 9/1998 Gershenson et al.
5,845,375 A 12/1998 Miller et al.
5,852,855 A 12/1998 Mody et al.
5,868,987 A 2/1999 Kampfer et al.
5,879,604 A 3/1999 Melbye et al.
5,980,230 A 11/1999 Dowd et al.
5,983,467 A 11/1999 Duffy et al.
6,000,106 A 12/1999 Kampfer et al.
6,039,911 A 3/2000 Miller et al.
6,076,238 A 6/2000 Arsenault et al.
6,124,015 A 9/2000 Baker et al.
6,133,173 A 10/2000 Riedel et al.
6,159,596 A 12/2000 Calhoun et al.
6,179,625 B1 1/2001 Davis et al.
6,248,276 B1 6/2001 Parellada et al.
6,276,032 B1 8/2001 Nortman et al.
6,280,670 B1 8/2001 Buzzell et al.
6,287,665 B1 9/2001 Hammer
6,303,062 B1 10/2001 Aamodt et al.

* cited by examiner

FASTENER ELEMENT PATTERNING

TECHNICAL FIELD

This invention relates to patterning touch fastener elements, and more particularly to self-engageable patterns of mushroom-type fastener elements.

BACKGROUND

Touch fasteners generally include those with male fastener elements, such as those shaped as mushrooms, palm trees or hooks, engageable with loop or fibrous elements or with complementary arrays or patterns of male fastener elements. Patterns of male fastener elements that are engageable with themselves, or with another fastener having a similar pattern, are called self-engageable. To be self-engageable, a fastener element pattern must have an arrangement of fastener elements that allow the heads of two identical such arrays to pass by one another, and then to engage one another with their overhanging portions. In order for the heads of the mating fasteners to pass one another during engagement, the overall percentage of the area of each fastener element array occupied by the footprints of the heads, or the head density as it is sometimes called, must be less than 50 percent. The ratio of individual inter-element engagements to the total number of fastener elements of one of the identical engaged arrays is the bulk engagement ratio. Because one fastener element may be simultaneously engaged with multiple fastener elements of another array, it is possible for bulk engagement ratios to exceed 100 percent. Typically, the stems of the fastener elements are flexible to allow the heads to pass by one another as the fastener arrays are brought into engagement.

In many previous patterns of fastener elements, the elements were arranged in straight, ordered rows, and very efficient methods are available for molding fastener element stems integrally with a base in straight rows, such as by continuous molding of stems and base on a rotating mold roll made up of stacked plates, many plates each providing the cavities for a respective row of fastener element stems, as disclosed in U.S. Pat. No. 4,794,028. After stem molding, the fastener element heads may be formed by heating the stem ends and then pressing against them with a chilled surface, as is shown in U.S. Pat. No. 6,248,276, or by otherwise flowing resin of the distal stem ends to form overhanging heads. While readily formed, many straight-row patterns tend to perform best for self-engagement at an engagement angle, the angle between the directions of extent of the rows of the engaged arrays, of zero degrees. For enabling engagement at a variety of other angles, it has been suggested that fastener elements should be arranged with a very low degree of order rather than in equally spaced, straight rows. While such unordered arrangements can provide for more uniform engagement rations over a wide variety of engagement angles, such that the mating arrays can be engaged without precise alignment, this typically comes at a reduction in the bulk engagement ratio at a zero degree engagement angle, the engagement orientation occurring most frequently in many fixed-position applications, and places some limitations on manufacturing method. Furthermore, with most unordered patterns there will be some degree of undesirable direct overlap of the stem positions of the engaging arrays in almost any engagement orientation, forcing the overlapped stems to buckle or significantly deflect laterally to complete engagement. The ratio of the number of overlapped stems to the overall number of fastener elements in one of the arrays is called the bulk overlap ratio.

Many straight row or otherwise highly ordered patterns allow the engaged arrays of fastener elements to move laterally with respect to each other, or slip. Gross slip can occur in the direction of the rows of some straight row patterns, or in incremental motions in multiple directions in other patterns.

Further improvements in the arrangement of fastener elements in self-engageable patterns are desired.

SUMMARY

According to one aspect of the invention, a touch fastener product has a sheet-form base and an array of fastener elements, each fastener element having a stem extending from a broad side of the base to a distal head overhanging the base. The fastener elements are arranged in an ordered pattern of straight rows, with the heads of the fastener elements covering the base at a head density of between about 20 and 35 percent. The fastener elements are arranged to define a sufficient number and pattern of pockets between associated groups of adjacent stems to provide a bulk locking ratio of at least 10 percent when engaged with an identical pattern at a zero degree engagement angle. Preferably, the head density is between about 25 to 33 percent, or about 31 percent for some applications.

In some embodiments, the fastener elements are arranged to have a bulk engagement ratio, when engaged with an identical pattern at a zero degree engagement angle, of at least 100 percent, preferably at least 150 percent, and more preferably at least 200 percent.

In some cases, the bulk locking ratio is at least 20 percent, preferably at least 25 percent.

The fastener elements, for some applications, are advantageously arranged in a repeating pattern of row groupings, with each row grouping having a three row band of fastener elements spaced apart from adjacent rows of fastener elements by a distance greater than row spacing within the band. In some cases, the three row band consists of two outer rows of laterally aligned fastener elements and a middle row of fastener elements longitudinally offset from adjacent fastener elements of the outer rows. The middle row is preferably equidistant from two adjacent fastener elements of each of the outer rows.

In some configurations, a clearance between opposing surfaces of adjacent fastener element heads along the middle row is less than a nominal lateral extent, measured long the middle row, of the fastener element heads, such that during engagement, at least some of the fastener element stems of the middle row are deflected.

Preferably, particularly in such configurations, a clearance between opposing surfaces of adjacent fastener elements of the outer rows, measured across the three row band, is greater than a nominal lateral extent, measured long the middle row, of the fastener element heads, such that engagement does not require the deflection of both fastener elements of each opposing outer row pair.

In some patterns, each row grouping comprises the three row band and at least one single row band of fastener elements. For example, in one case, each row group consists of the three row band and a single row band of fastener elements spaced midway between the three row band of the grouping and a three row band of an adjacent grouping. In another illustrated pattern, each row group consists of the three row band and two single row bands of fastener elements separated by a distance greater than the row spacing within the three row band.

In some embodiments, the fastener elements are arranged in a repeating pattern of four-element clusters, with each cluster consisting of four fastener elements arranged at four corners of a four-sided polygonal area and spaced from adjacent clusters by a distance greater than a greatest side length of the polygonal area. The four-sided polygonal area may be rectangular, for example, or substantially square.

In some constructions, the fastener elements are arranged in a repeating pattern of four-element clusters, with each cluster consisting of four fastener elements arranged at four corners of a four-sided polygonal area. A clearance between a first pair of opposing fastener element heads at opposite corners of the area is greater than a nominal diameter of the fastener element heads, and a clearance between a second pair of opposing fastener element heads at opposite corners of the area is less than the nominal diameter of the fastener element heads.

For many touch fastener applications, the array should have an overall fastener element density of at least 200 fastener elements per square inch (31 fastener elements per square centimeter), preferably at least 500 fastener elements per square inch (78 fastener elements per square centimeter).

The array should include, for most tough fastener applications, at least 10 rows of at least 50 fastener elements each.

In many embodiments, the fastener element stems have one or more of the following features: they are of square or rectangular cross-section; they extend perpendicular to the base; and they are integrally molded with the base. In particular, integral molding of the fastener element stems and the base offers several advantages, such as avoiding the need to handle and attach individual stems, and elimination of a stem-base interface.

In many constructions, the fastener element heads have one or more of the following features: they each have upper surfaces that are generally flat over an area covering their respective stems; they each have an overall thickness, measured along their respective stems, of less than about 0.015 inch (0.38 millimeter); and they each have a maximum lateral extent, measured in a direction perpendicular to their respective stems, of between about 0.01 and 0.04 inch (0.25 and 1.0 millimeter).

In some patterns, the fastener element heads each have a lateral extent, measured along their respective rows, greater than a nominal distance between opposing surfaces of adjacent heads within each row.

In some preferred embodiments, the touch fastener has an overall thickness, including a thickness of the sheet-form base and an average height of the fastener elements, of less than about 0.075 inch (1.9 millimeters).

It is preferred that the fastener elements are arranged to have a bulk overlap ratio, when engaged with an identical pattern at a zero degree engagement angle, of less than about 2.0 percent, more preferably about zero percent.

It is also preferred that the fastener elements be constructed and arranged to provide an engagement resistance ratio, when engaged with an identical pattern at a 45 degree engagement angle, of less than about 2.5, more preferably less than about 2.0.

In some cases, the fastener elements are constructed and arranged to provide an engagement resistance ratio, when engaged with an identical pattern at a 90 degree engagement angle, of less than about 1.7, preferably less than about 1.2.

One aspect of the invention features folding such a fastener product over onto itself and engaging two portions of the fastener element array. Another aspect features such a fastener product so folded over and engaged with itself. Yet another aspect features two strips of the above-described product with their respective arrays of fastener elements engaged, such as at a zero degree engagement angle. Such an engaged pair of fastener strips preferably has an overall thickness, when compressed under a light load sufficient to engage the fastener elements of each strip against the base of the other strip, of less than about 0.08 inch (2 millimeters).

According to yet another aspect of the invention, a touch fastener product has a sheet-form base and an array of fastener elements, with each fastener element having a stem extending from a broad side of the base to a distal head overhanging the base and having an upper surface that is generally flat over an area covering its respective stem. The fastener elements are arranged in an ordered pattern of straight rows, with the fastener element heads covering the base at a head density of between about 20 and 35 percent. The fastener elements are arranged to provide a bulk engagement ratio of at least 100 percent when engaged with an identical pattern at a zero degree engagement angle.

In some preferred embodiments, the fastener elements are arranged to define a sufficient number and pattern of pockets between associated groups of adjacent stems to provide a bulk locking ratio of at least 10 percent when engaged with an identical pattern at a zero degree engagement angle.

Preferably, the fastener element stems are integrally molded with and extend perpendicularly from the base.

In many preferred patterns, the fastener elements are arranged in a repeating pattern of row groupings, with each row grouping having a three row band of fastener elements spaced apart from adjacent rows of fastener elements by a distance greater than row spacing within the band. The three row band may consist of two outer rows of laterally aligned fastener elements and a middle row of fastener elements longitudinally offset from adjacent fastener elements of the outer rows, for example.

In some patterns, the fastener elements are arranged in a repeating pattern of four-element clusters, with each cluster consisting of four fastener elements arranged at four corners of a four-sided polygonal area and spaced from adjacent clusters by a distance greater than a greatest side length of the polygonal area.

In some cases, the fastener elements are arranged in a repeating pattern of four-element clusters, with each cluster consisting of four fastener elements arranged at four corners of a four-sided polygonal area, a clearance between a first pair of opposing fastener element heads at opposite corners of the area being greater than a nominal diameter of the fastener element heads, and a clearance between a second pair of opposing fastener element heads at opposite corners of the area being less than the nominal diameter of the fastener element heads.

The fastener elements are preferably arranged to have a bulk overlap ratio, when engaged with an identical pattern at a zero degree engagement angle, of less than about 2.0 percent.

The fastener elements are also preferably constructed and arranged to provide an engagement resistance ratio, when engaged with an identical pattern at a 45 degree engagement angle, of less than about 2.5.

According to another aspect of the invention, a touch fastener product has a sheet-form base and an array of fastener elements, each fastener element having a stem extending from a broad side of the base to a distal head overhanging the base. The fastener elements are arranged in a repeating pattern of row groupings, each row grouping having a three row band of fastener elements spaced apart from adjacent rows of fastener elements by a distance greater than row spacing within the band.

Preferably, the fastener element stems are integrally molded with, and extend perpendicularly from, the base, and the fastener elements are arranged in an ordered pattern of straight rows.

The fastener elements are arranged, in some patterns, to provide a bulk engagement ratio of at least 100 percent when engaged with an identical pattern at a zero degree engagement angle.

In some embodiments, the fastener elements are arranged to define a sufficient number and pattern of pockets between associated groups of adjacent stems to provide a bulk locking ratio of at least 10 percent when engaged with an identical pattern at a zero degree engagement angle.

In some arrangements, the three row band consists of two outer rows of laterally aligned fastener elements and a middle row of fastener elements longitudinally offset from adjacent fastener elements of the outer rows. Preferably, each fastener element of the middle row is equidistant from two adjacent fastener elements of each of the outer rows.

In some configurations, a clearance between opposing surfaces of adjacent fastener element heads along the middle row is less than a nominal lateral extent, measured long the middle row, of the fastener element heads, such that during engagement, at least some of the fastener element stems of the middle row are deflected.

Preferably, particularly in such configurations, a clearance between opposing surfaces of adjacent fastener elements of the outer rows, measured across the three row band, is greater than a nominal lateral extent, measured long the middle row, of the fastener element heads, such that engagement does not require the deflection of both fastener elements of each opposing outer row pair.

In some patterns, each row grouping comprises the three row band and at least one single row band of fastener elements. For example, in one case, each row group consists of the three row band and a single row band of fastener elements spaced midway between the three row band of the grouping and a three row band of an adjacent grouping. In another illustrated pattern, each row group consists of the three row band and two single row bands of fastener elements separated by a distance greater than the row spacing within the three row band.

Preferably, the fastener element heads cover the base at a head density of between 20 and 35 percent, and the array has an overall fastener element density of at least 200 fastener elements per square inch (31 fastener elements per square centimeter).

According to another aspect of the invention, a touch fastener product includes a sheet-form base and an array of fastener elements each having a stem extending from a broad side of the base to a distal head overhanging the base, with the fastener elements arranged in an ordered pattern of straight rows. Notably, the fastener elements are constructed and arranged to provide an engagement resistance ratio, when engaged with an identical pattern at a 45 degree engagement angle, of less than about 2.5 (preferably, less than about 2.0).

In some embodiments, the fastener elements are constructed and arranged to provide an engagement resistance ratio, when engaged with an identical pattern at a 90 degree engagement angle, of less than about 1.8 (preferably, less than about 1.2).

By proper patterning, engagement and performance properties of self-engageable fastener element arrays can be enhanced, while maintaining a high degree of pattern order that lends itself to various manufacturing processes and tooling. In many cases, this can even be accomplished with fastener elements aligned in straight rows. Many of these patterns and fastener element constructions are also useful for engaging loops or fibers of a female fastener.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
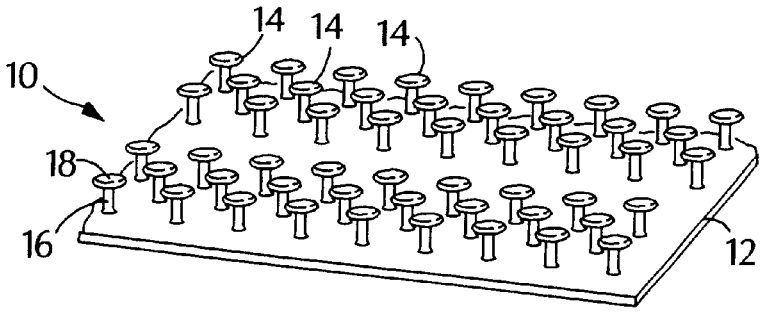
FIG. 1 is a perspective view of a self-engageable fastener.

Referring first to FIG. 1, fastener 10 consists of a sheet-form, flexible resin base 12 and an array of mushroom-shaped fastener elements 14. Each fastener element 14 has a stem 16 integrally molded with and extending perpendicularly from a broad side of base 12 to a distal head 18 that overhangs the base on substantially all sides of the stem. As shown, fastener elements 14 are arranged in an ordered pattern of straight, parallel rows. Such fasteners 10 can be formed of thermoplastic materials, for example, in continuous processes as discussed below.

Figure 2:
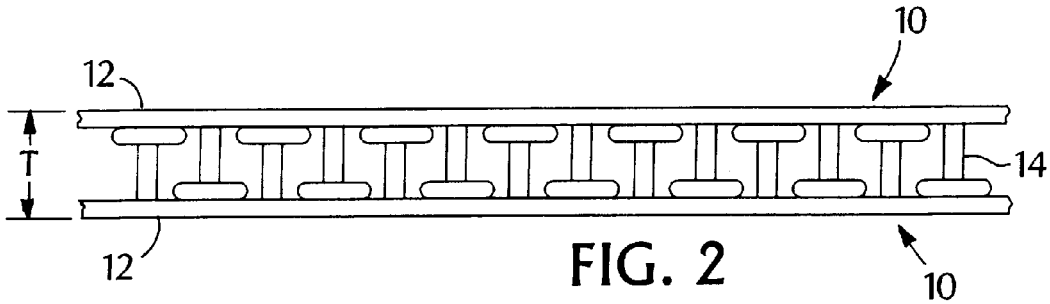
FIG. 2 is a side view of the fastener engaged with an identical fastener.

As shown in FIG. 2, the pattern of fastener elements is such that two identical fasteners 10 can be interlocked to form a releasable fastening, by engaging their respective arrays of fastener elements 14. Likewise, an extended length of fastener 10 can be folded so as to overlap two portions of its fastener element array, so as to engage itself. Preferably, the engaged fasteners, at rest, have a combined thickness "T" of less than about 2.0 millimeters, more preferably less than about 1.5 millimeters.

Figure 3:
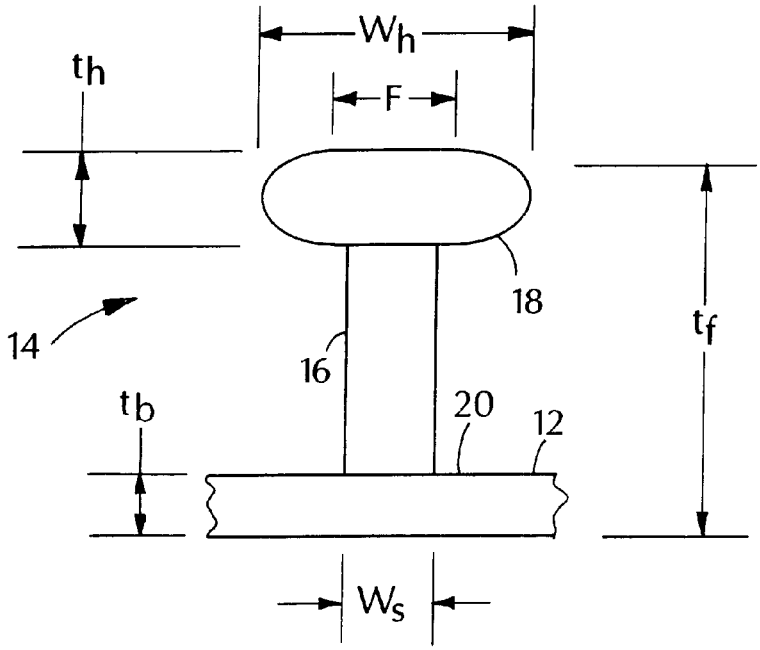
FIG. 3 is an enlarged side view of a single fastener element.

FIG. 3 illustrates a typical fastener element 14. In this illustrated example of a low profile fastener, molded stem 16 is of square cross-section with width $W_S$ of about 0.007 to 0.012 inch (0.18 to 0.3 millimeter) and rises integrally from a near surface 20 of base 12. Base 12 is generally planar and has a nominal thickness $t_b$ of about 0.008 to 0.022 inch (0.2 to 0.56 millimeter). Head 18 is typically formed of resin of molded stem 16 to overhang base 12, in a post-molding process, and is not itself of molded shape. However, a preferred head shape is one that overhangs the base on substantially all sides of stem 16 and has a thickness $t_h$ of about 0.01 to 0.014 inch (0.25 to 0.36 millimeter). Produced by the forming methods outlined below and in U.S. Pat. No. 6,248,276 on a square stem, head 18 will generally be of circular or slightly oval footprint, with a major dimension $W_h$ aligned in the direction of processing, of about 2.00 to 2.25 times stem thickness $W_S$, or about 0.014 to 0.027 inch (0.56 to 0.76 millimeter) for preferred stem widths. In this example, head 18 is of circular cross-section and has a diameter $W_h$ of about 0.0264 inch (0.671 millimeter). The overall thickness $t_f$ of the fastener, including the base thickness and the height of the fastener elements, is about 0.052 to 0.071 inch (1.3 to 1.8 millimeters). It should also be noted that in this embodiment, the upper surface of head 18 is generally flat over a central region "F" that covers the footprint of the underlying stem 16. Having such a relatively wide flat region can help an array of such fastener elements to readily slide across a mating array before engagement, such as to enable a user to position the fasteners after contact but prior to engagement. Flat upper surface regions also improve the feel of the array against skin by avoiding abrasiveness, and help to distribute normal loads against a mating surface during compression.

In a high profile example, square stem 16 width $W_s$ is about 0.018 inch (0.46 millimeter), and major head dimension $W_h$ is about 0.0378 inch (0.960 millimeters). In this high profile example, the overall thickness $t_f$ of the fastener is about 0.040 to 0.115 inch (1.0 to 2.9 millimeters), with a base thickness of 0.008 to 0.020 inch (0.2 to 0.5 millimeter).

Other stem configurations are also possible. For example, some stems are inserted through the fastener base as separate elements, rather than being integrally molded of the same material. Such assembly processes can be more expensive, however, than integral molding. The stems may also be of different cross-section than square or rectangular. For example, some stems of circular cross-section can be molded integrally with the base on a roll having plates with aligned, half-cylinder grooves machined or etched into their side surfaces, with the grooves of each abutting plate aligned with those of the next to form cylindrical stem molding cavities.

Figure 4:
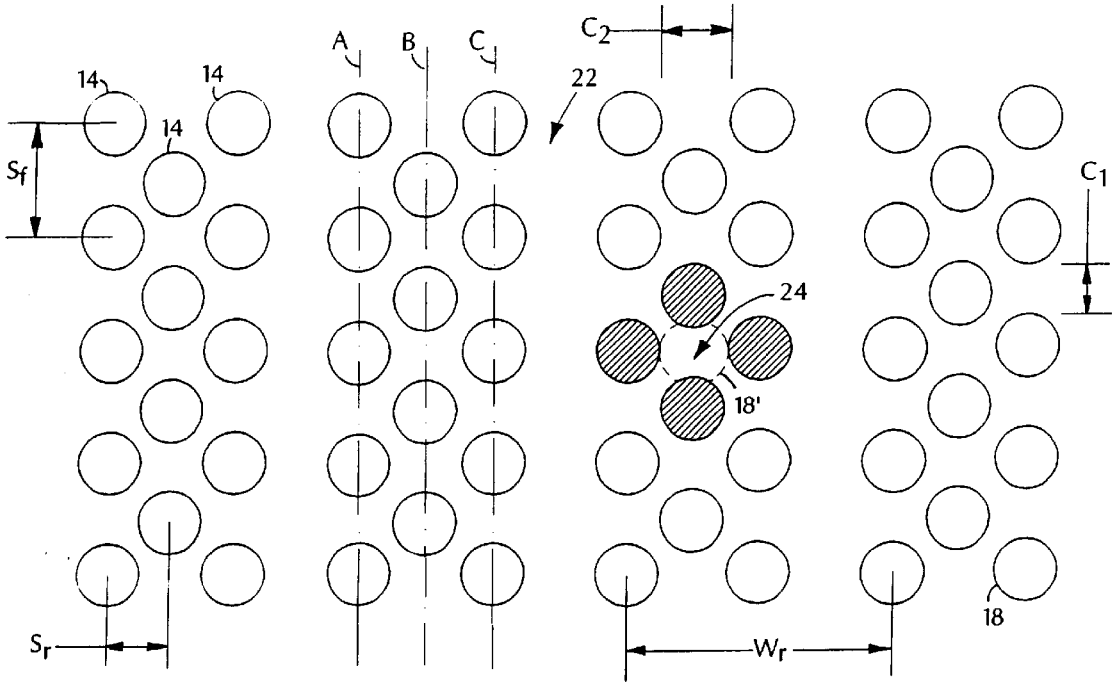
FIG. 4 shows a first fastener element head pattern.

Referring next to FIG. 4, fastener elements 14 are arranged in repeating groups of three rows each. These rows are identified in the second row group from left as outer rows A and C and middle row B. The row spacing $S_R$ within each row group is constant, and about 0.028 inch (0.71 millimeter) in this example, with middle row B disposed equidistant from rows A and C, such that rows A and C are separated by about 0.056 inch (1.14 millimeters). The fastener elements spacing $S_F$ is constant along each row, and about 0.046 inch (1.17 millimeters) in this example. Each middle row B is longitudinally offset from its associated outer rows A and C, such that its fastener elements 14 are each disposed midway between adjacent fastener elements 14 in the outer rows. Each three row group is separated from the next three row group by a longitudinal track 22 clear of fastener elements. In this example, the pattern of row group and spacing has a repeat width $W_R$ of about 0.114 inch (2.90 millimeters), just slightly greater than the repeat width that would be obtained by taking a full staggered array of row spacing $S_R$ and removing every fourth row, and the heads 18 of the fastener elements are drawn at a nominal diameter of 0.0264 inch (0.671 millimeter), or an average of about 2.2 times the stem width.

The grouping of fastener element rows into three row groupings, each with a middle staggered row B and spaced from adjacent groups, can be particularly advantageous for self-engagement performance as it provides a sufficient bulk locking ratio at a particularly low head density. Each row group defines a longitudinal row of inter-element receptacles 24, each bounded by four fastener elements 14 and sized to receive and hold a fastener element head of a mating array on at least three sides. One such receptacle 24 is illustrated between four highlighted fastener elements, with the dashed outline of a fastener element head 18' engaging between the highlighted fastener elements. Given the above inter-row spacing, inter-element spacing and head diameters, the clearance $C_1$ between adjacent heads along each row is about 0.02 inch (0.5 millimeter), or slightly less than the nominal head diameter, while the clearance $C_2$ between transversely aligned fastener elements is about 0.03 inch (0.75 millimeter), or slightly greater than the nominal head diameter. Thus, a mating fastener element head 18' need only laterally deflect one fastener element of middle row B during engagement.

Figure 5:
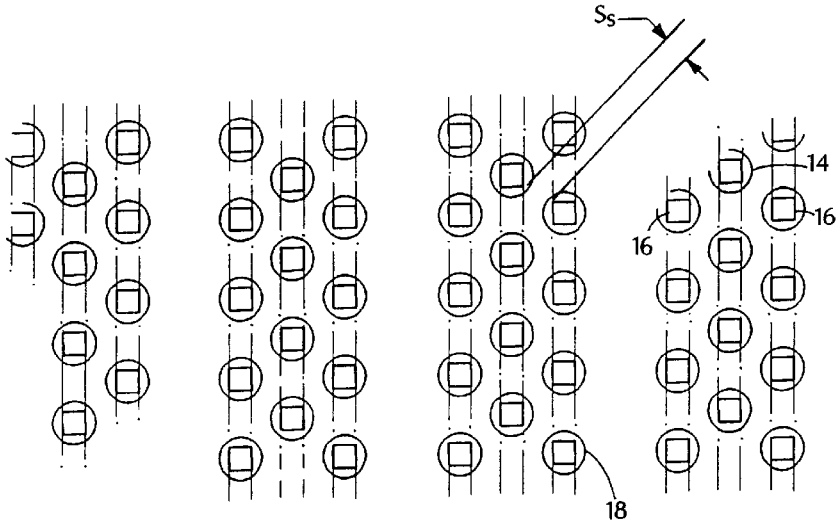
FIG. 5 shows the pattern of FIG. 4, with fastener element stem outlines shown.

FIG. 5 also shows the cross-sectional area of the square stem 16 of each fastener element 14, and shows in dashed outline the thickness of the molding and spacer plates of the mold roll employed to form the base and stems of the fastener. As can be seen in this view, the minimum corner separation $S_S$ between the stems 16 of adjacent fastener elements in middle and outer rows of each row grouping, is less than the nominal diameter of the fastener element heads, such that a trapped fastener element head 18' (FIG. 4) is obstructed from moving laterally from its receptacle 24 in any direction, once engaged. Thus, each locked head is trapped in a cage formed by four adjacent fastener element stems 16. In this example, stem corner separation $S_S$ is about 0.0194 inch (0.49 millimeter), significantly less than the nominal head diameter of 0.0264 inch (0.671 millimeter).

Fastener elements having the above dimensions and arranged in the pattern of FIG. 4 provide an overall head density of 585 hooks per square inch (91 hooks per square centimeter), and a head density of about 29.2 percent. The bulk engagement, locking and overlap ratios were calculated to be 228 percent, 25.4 percent, and zero percent, respectively.

In a high profile example of the pattern of FIG. 4, the labeled dimensions are 0.069 inch (1.75 millimeters) for SF, 0.176 inch (4.47 millimeters) for WR, and 0.044 inch (1.1 millimeters) for SR, with a stem corner separation SS of about 0.0308 inch (0.78 millimeter).

Figure 6:
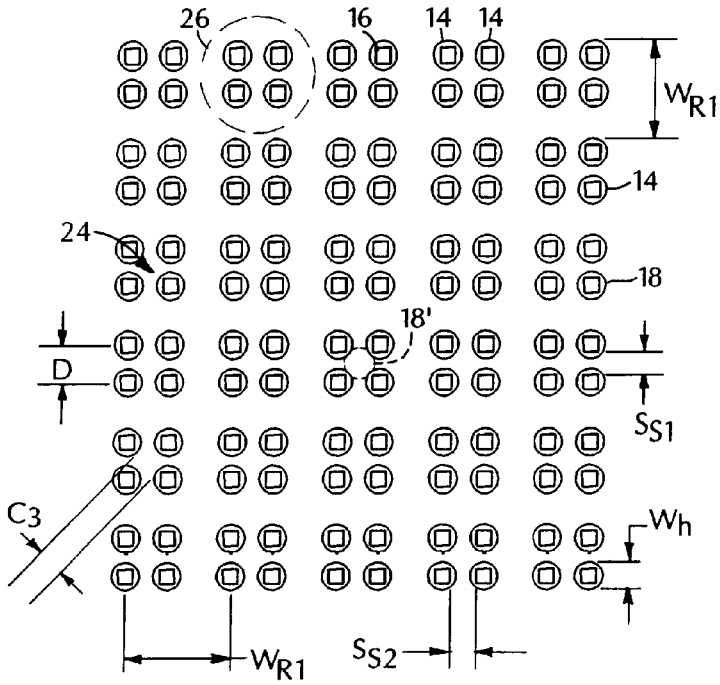
FIG. 6 shows a second fastener element pattern.

Another pattern that provides reasonable head entrapment at a relatively low head density is shown in FIG. 6. In this case, each straight row of fastener elements 14 consists of closely spaced pairs of fastener elements aligned with a respective pair of an adjacent row, such that the resulting array of fastener elements consists of equally spaced groups 26 of four fastener elements each, with the fastener elements of each group disposed at the corners of an almost-square rectangle and defining a receptacle 24 for receiving a fastener element head of a mating array between them. Each fastener element 14 is of the same dimensions as the fastener elements of FIG. 4, except that the nominal head diameter $W_h$ is illustrated at about 0.0252 inch (0.64 millimeter). Notably, the inter-stem clearance between adjacent stems within each group 26 is less than the nominal head diameter.

In this example, longitudinal stem spacing $S_{S1}$ is about 0.021 inch (0.53 millimeter), and transverse stem spacing $S_{S2}$ is about 0.022 inch (0.56 millimeter), small enough that the four stems 16 of each group 26 form a four-bar cell to prevent exodus of a trapped fastener element head. Notably, the diagonal clearance $C_3$ between fastener element heads 18 within each group 26 is about 0.022 inch (0.056 millimeter), or slightly smaller than the nominal head diameter. The spacing between groups 26 is such that the pattern repeats at an interval $W_{R1}$ of about 0.067 inch (1.70 millimeters) along the rows, and a transverse interval $W_{R2}$ of about 0.068 inch (1.73 millimeters).

The arrangement of FIG. 6 provides an overall head density of 676 hooks per square inch (105 hooks per square centimeter), and a head density of about 28.7 percent. The bulk engagement, locking and overlap ratios were calculated to be 213 percent, 25.0 percent, and zero percent, respectively.

In a high profile example of a product with an array patterned after FIG. 6 and with 0.018 inch (0.46 millimeter) square stems, the labeled dimensions are 0.129 inch (3.28 millimeters) for $W_{R1}$, 0.130 inch (3.30 millimeters) for $W_{R2}$, 0.0378 inch (0.96 millimeter) for $W_h$, and 0.036 inch (0.91 millimeter) for both $S_{S1}$ and $S_{S2}$.

Figure 7:
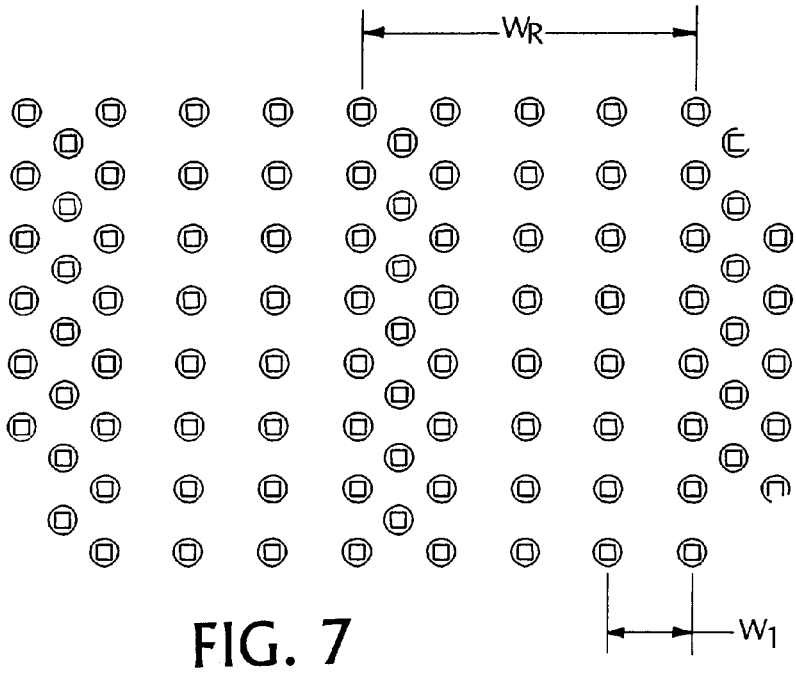
FIG. 7 shows a third fastener element pattern.

Another fastener element pattern is shown in FIG. 7. This pattern includes the same three row grouping and fastener element dimensions of the pattern of FIG. 4, but with the addition of two single rows to the repeating row pattern. The distance $W_1$ from each three row group to an adjacent single row is equal to the distance between the single rows, and about 0.058 inch (1.47 millimeter) in this example, such that the repeat pattern width $W_R$ is about 0.23 inch (5.8 millimeters). This arrangement provides an overall head density of 501 hooks per square inch (78 hooks per square centimeter), and a head density of about 25.0 percent. The bulk engagement, locking and overlap ratios were calculated to be 181 percent, 13.7 percent, and zero percent, respectively.

Figure 8:
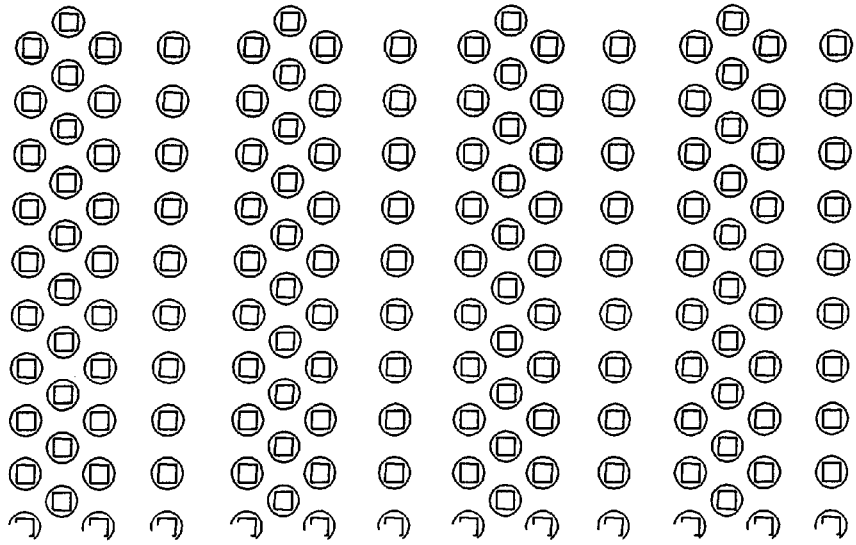
FIG. 8 shows a fourth fastener element pattern.

The pattern of FIG. 8 is similar to the one of FIG. 7, but with only one single row between adjacent three row groups. Otherwise, the dimensions of the pattern are the same, such that the repeat pattern width $W_R$ is about 0.172 inch (4.37 millimeters). This arrangement provides an overall head density of 522 hooks per square inch (81 hooks per square centimeter), and a head density of about 26.0 percent. The bulk engagement, locking and overlap ratios were calculated to be 194 percent, 16.9 percent, and zero percent, respectively.

Figure 9:
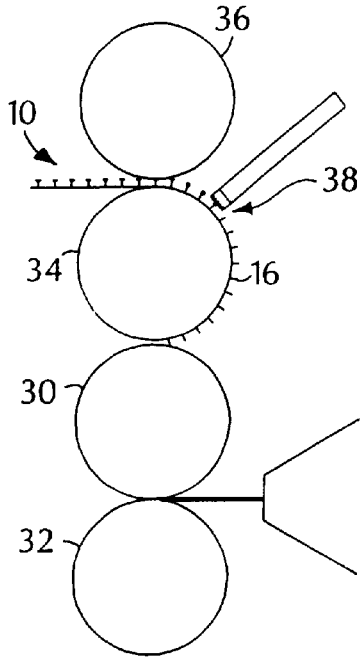
FIGS. 9 and 10 illustrate a fastener element forming method.
Figure 10:
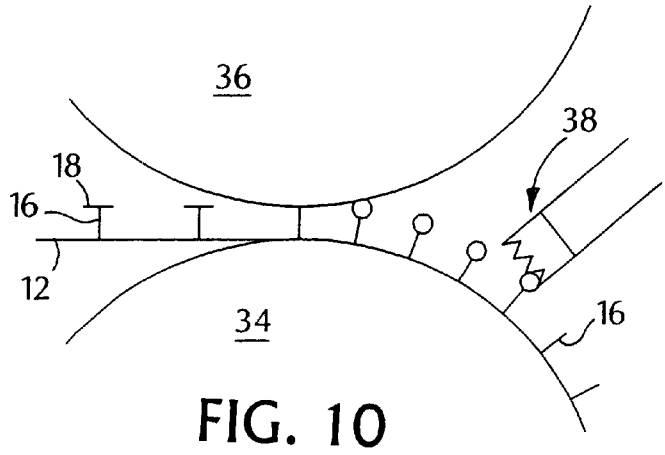

FIGS. 9 and 10 briefly illustrate a preferred method of forming the fastener elements of the above patterns in a continuous process. Molten resin is introduced to a mold roll 30, either in a nip between the mold roll and a counter-rotating pressure roll 32, as shown, or directly with a pressurized shoe (not shown). The resin is forced into an array of cavities and cooled on roll 30 to integrally form stems extending from a side of a sheet of resin that cools on the surface of roll 30 before being stripped from roll 30 and passed about roll 34. While on roll 34, immediately before encountering head-forming roll 36, the distal ends of the stems 16 are rapidly heated, either by a flame 38 as shown, or by a heated platen, keeping the remainder of the stems and base sheet relatively cool. The molten ends are then deformed by rotating roll 36, that is kept at a temperature lower than that of the incoming stem ends, as shown in FIG. 10. Stems molded with a height of 0.076 inch (1.9 millimeters), for example, are deformed in one embodiment to a final height of about 0.050 inch (1.3 millimeters), with relatively flat upper head surfaces. More details of this process can be found in U.S. Pat. No. 6,248,276.

Bulk locking, engagement and overlap characteristics at zero degree engagement angles are determined in accordance with the following procedures, which can be performed readily with current computer-aided-drafting (CAD) techniques.

Figure 11A:
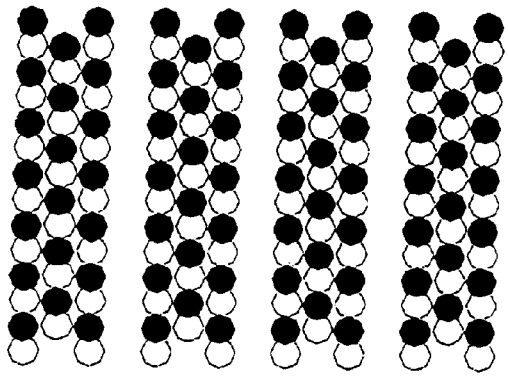
FIGS. 11A–11C illustrate array shifting for calculating pattern parameters.
Figure 11B:
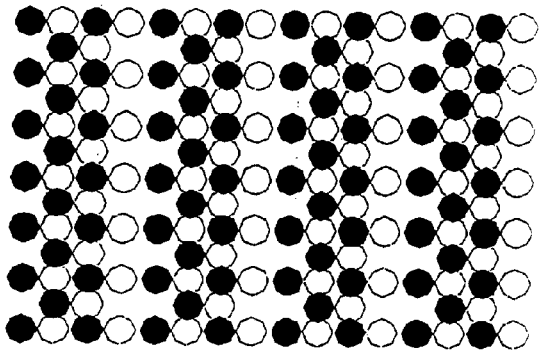
Figure 11C:
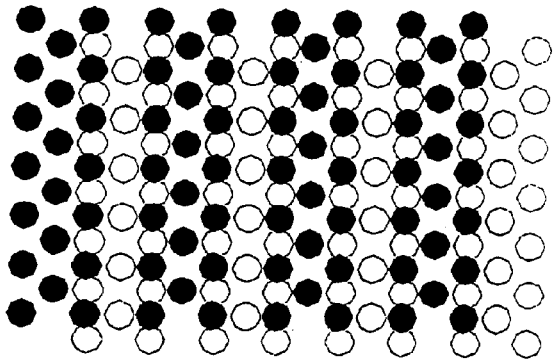

First, a model of the plan view of the pattern is created, containing only the lateral outline of each fastener element head and their associated stems, at proper spacing from other fastener element heads and stems. Then a copy of this pattern is created and trimmed to one inch (25.4 millimeters) square (the duplicate), such as in a different layer of the CAD model, and superimposed directly over the first pattern (the original). The duplicate is then moved transversely, in a direction perpendicular to the rows of fastener elements, a distance equal to one row spacing, and then moved longitudinally, in a direction parallel to the rows, only until the fastener elements of the duplicate are generally aligned between fastener elements of the original (typically, about one half of the intra-row fastener element spacing). FIG. 11A illustrates this first engageable position for the pattern of FIG. 4, with the fastener element heads of the original highlighted. In this position, the overlapping stem areas are counted (in this example, there are no overlapping stems in this position) and recorded. Next, the duplicate is moved transversely one row spacing and longitudinally shifted to a next engageable position (FIG. 11B illustrates such a position for the pattern of FIG. 4), and the overlapping stems across the one square inch (6.45 square centimeter) extent of the duplicate pattern are again counted. This is repeated until the extent of the repeating row pattern is reached, and the number of overlapping stems is averaged between the analyzed positions and then divided by the number of stems per square inch to obtain the bulk overlap ratio. FIG. 11C illustrates a third analysis position for the pattern of FIG. 4, which requires analysis at a total of four positions before the row sequence repeats.

The above procedure is similar to that for calculating the bulk engagement ratio, except that at each engageable position, the number of hook-hook engagements is counted rather than the number of overlapping stems. Note that any single hook head may be simultaneously engaged with multiple heads of the mating pattern, with each engagement counted separately. In each position, the duplicate should be shifted laterally from its initial placement to maximize engagement with fastener elements of the original, but no more than one-half of a row spacing in any direction. This simulates field use, in which perfect alignment rarely occurs and where some shear loading is almost always present.

Bulk locking ratio is calculated similarly, except that it is only analyzed for arrays in which the fastener element stems are spaced close enough to prevent a head trapped in a receptacle, defined between four adjacent stems in two or three adjacent rows, from moving laterally out of the receptacle. At each analysis position of the two overlapped patterns, what is counted is the number of fastener element heads of the duplicate that are within receptacles of the original. A head of the duplicate is said to be within a receptacle of the original if the entire extent of any flat portion of the head surface is within a polygon connecting the centers of all of the fastener elements defining the receptacle. Such fastener element heads are said to be "locked" against gross lateral movement, even though they may freely move within the receptacle. For example, most of the fastener elements of the far left row of the duplicate in FIG. 11B are locked between fastener elements of the original, while none of the fastener elements of the duplicate in FIG. 11C are locked.

Figure 12A:
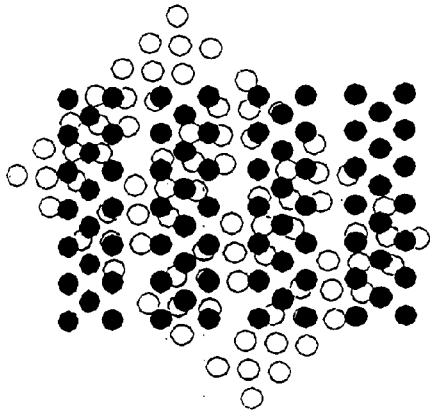
FIGS. 12A and 12B show the pattern of FIG. 4 engaged with an identical pattern at engagement angles of 45 and 90 degrees, respectively.
Figure 12B:
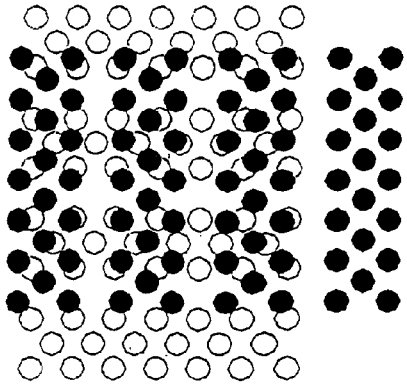

Besides demonstrating a good zero engagement angle performance, many of the patterns described above also provide reasonable performance at other engagement angles, even with their high degree of order. FIGS. 12A and 12B, for example, illustrate engagement of two patterns of FIG. 4 at engagement angles of 45 and 90 degrees, respectively. One way to rate the engagement and strength performance of patterns at various angles is to compare the levels of force required for engagement with those at a zero degree engagement angle. These values can be measured by mounting duplicate fasteners to rigid blocks, with the area of overlap known, bringing the blocks together gently at the desired engagement angle and laterally adjusting the relative position of the fasteners to promote engagement, then slowly increasing engagement load until the fasteners engage. The maximum force for engagement is recorded and then divided by the engagement load at a zero degree engagement angle, to generate an engagement resistance ratio. An ideal, omni-directional fastener would have, therefore, an engagement resistance ratio of 1.0 as there would be no performance variation with engagement angle.

Besides providing good performance at a zero degree engagement angle, many of the above patterns also provide an improved degree of omni-directionality as compared with some other highly ordered patterns. The embodiment shown in FIG. 4, for example, was molded from high density polyethylene (HDPE) and demonstrated an engagement resistance ratio of about 1.65 at 90 degrees, and about 2.0 at 45 degrees. The embodiment of FIG. 6, on the other hand, as formed of HDPE, demonstrated an engagement resistance ratio of about 1.71 at 45 degrees, and only about 0.8 at 90 degrees. This similarity of engagement resistance at zero and 90 degrees would be expected, given the symmetry of the pattern of FIG. 6.

The above products can be produced from various thermoplastics and other resins. A high density polyethylene, such as Exxon Mobil #6908, can be useful for some applications. Other suitable materials include low density polyethylene (LDPE), polypropylene and nylon.

The entire contents of U.S. Pat. Nos. 6,248,276 and 4,794,028 are hereby incorporated by reference herein, as if completely set forth.

A number of embodiments of the invention have been described. Nevertheless, it will be understood that various modifications may be made without departing from the spirit and scope of the invention. Accordingly, other embodiments are within the scope of the following claims.

What is claimed is:

1. A touch fastener product comprising a sheet-form base; and an array of fastener elements each having a stem extending from a broad side of the base to a distal head overhanging the base, the fastener elements arranged in an ordered pattern of straight rows;

wherein the heads of the fastener elements cover the base at a head density of between about 20 and 35 percent; and wherein the fastener elements are arranged to define a sufficient number and pattern of packets between associated groups of adjacent stems to provide a bulk locking ratio of at least 10 percent when engaged with an identical pattern at a zero degree engagement angle.

2. The touch fastener of claim 1 wherein the head density is between about 25 to 33 percent.

3. The touch fastener of claim 2 wherein the head density is about 31 percent.

4. The touch fastener of claim 1 wherein the fastener elements are arranged to have a bulk engagement ratio, when engaged with an identical pattern at a zero degree engagement angle, of at least 100 percent.

5. The touch fastener of claim 4 wherein the bulk engagement ratio is at least 150 percent.

6. The touch fastener of claim 5 wherein the bulk engagement ratio is at least 200 percent.

7. The touch fastener of claim 1 wherein the bulk locking ratio is at least 20 percent.

8. The touch fastener of claim 7 wherein the bulk locking ratio is at least 25 percent.

9. The touch fastener of claim 1 wherein the fastener elements are arranged in a repeating pattern of row groupings, each row grouping having a three row band of fastener elements spaced apart from adjacent rows of fastener elements by a distance greater than row spacing within the band.

10. The touch fastener of claim 9 wherein the three row band consists of two outer rows of laterally aligned fastener elements and a middle row of fastener elements longitudinally offset from adjacent fastener elements of the outer rows.

11. The touch fastener of claim 10 wherein each fastener element of the middle row is equidistant from two adjacent fastener elements of each of the outer rows.

12. The touch fastener of claim 10 wherein a clearance between opposing surfaces of adjacent fastener element heads along the middle row is less than a nominal lateral extent, measured along the middle row, of the fastener element heads.

13. The touch fastener of claim 10 wherein a clearance between opposing surfaces of adjacent fastener elements of the outer rows, measured across the three row band, is greater than a nominal lateral extent, measured along the middle row, of the fastener element heads.

14. The touch fastener of claim 13 wherein a clearance between opposing surfaces of adjacent fastener element heads along the middle row is less than a nominal lateral extent, measured along the middle row, of the fastener element heads.

15. The touch fastener of claim 9 wherein each row grouping comprises the three row band and at least one single row band of fastener elements.

16. The touch fastener of claim 15 wherein each row group consists of the three row band and a single row band of fastener elements spaced midway between die three row band of the grouping and a three row band of an adjacent grouping.

17. The touch fastener of claim 15 wherein each row group consists of the three row band and two single row bands of fastener elements separated by a distance greater than the row spacing within the three row band.

18. The touch fastener of claim 1 wherein the fastener elements are arranged in a repeating pattern of four-element clusters, each cluster consisting of four fastener elements arranged at four corners of a four-sided polygonal area and spaced from adjacent clusters by a distance greater than a greatest side length of the polygonal area.

19. The touch fastener of claim 18 wherein the four-sided polygonal area is rectangular.

20. The touch fastener of claim 18 wherein the polygonal area is substantially square.

21. The touch fastener of claim 18 wherein the fastener elements are arranged in a repeating pattern of four-element clusters, each cluster consisting of four fastener elements arranged at four corners of a four-sided polygonal area, a clearance between a first pair of opposing fastener element heads at opposite corners of the area being greater than a nominal diameter of the fastener element heads, and a clearance between a second pair of opposing fastener element heads at Opposite corners of the area being less than the nominal diameter of the fastener element heads.

22. The touch fastener of claim 1 wherein the array has an overall fastener element density of at least 200 fastener elements per square inch (31 fastener elements per square centimeter).

23. The touch fastener of claim 22 wherein the fastener element density is at least 500 fastener elements per square inch (78 fastener elements per square centimeter).

24. The touch fastener of claim 1 wherein the array includes at least 10 rows of at least 50 fastener elements each.

25. The touch fastener of claim 1 wherein the fastener element stems extend perpendicular to the base.

26. The touch fastener of claim 1 wherein the fastener element heads each have upper surfaces that are generally flat over an area covering their respective stems.

27. The touch fastener of claim 1 wherein the fastener element heads each have an overall thickness, measured along their respective stems, of less than about 0.015 inch (0.38 millimeter).

28. The touch fastener of claim 1 wherein the fastener element stems are of square cross-section.

29. The touch fastener of claim 1 wherein the fastener element heads each have a maximum lateral extent, measured in a direction perpendicular to their respective stems, of between about 0.01 and 0.04 inch (025 and 1.0 millimeter).

30. The touch fastener of claim 1 having an overall thickness, including a thickness of the sheet-form base and an average height of the fastener elements, of less than about 0.075 inch (1.9 millimeters).

31. The touch fastener of claim 1 wherein the fastener element heads each have a lateral extent, measured along their respective rows, greater than a nominal distance between opposing surfaces of adjacent heads within each row.

32. The touch fastener of claim 1 wherein the fastener element stems are integrally molded with and extend perpendicularly from the base.

33. The touch fastener of claim 1 wherein the fastener elements are arranged to have a bulk overlap ratio, when engaged with an identical pattern at a zero degree engagement angle, of less than about 2.0 percent.

34. The touch fastener of claim 33 wherein the bulk overlap ratio is about zero percent.

35. The touch fastener of claim 1 wherein the fastener elements are constructed and arranged to provide an engagement resistance ratio, when engaged with an identical pattern at a 45 degree engagement angle, of less than about 2.5.

36. The touch fastener of claim 35 wherein the engagement resistance ratio is less than about 2.0.

37. The touch fastener of claim 1 wherein the fastener elements are constructed and arranged to provide an engagement resistance ratio, when engaged with an identical pattern at a 90 degree engagement angle, of less than about 1.7.

38. The touch fastener of claim 37 wherein the engagement resistance ratio is loss than about 1.2.

39. The touch fastener of claim 1 folded over and engaged with itself.

40. In combination, two strips of the product of claim 1 with their respective arrays of fastener elements engaged at a zero degree engagement angle.

41. The combination of claim 40 having an overall thickness, when compressed under a light load sufficient to engage the fastener elements of each strip against the base of the other strip, of less than about 0.08 inch (2 millimeters).

42. A touch fastener product comprising a sheet-form base; and an array of fastener elements each having a stem extending from a broad side of the base to a distal head overhanging the base and having an upper surface that is generally flat over an area covering its respective stem, the fastener elements arranged in an ordered pattern of straight rows;

wherein the fastener element heads cover the base at a head density of between about 20 and 35 percent; and wherein the fastener elements are arranged to provide a bulk engagement ratio of at least 100 percent when engaged with an identical pattern at a zero degree engagement angle.

43. The touch fastener of claim 42 wherein the fastener elements are arranged to define a sufficient number and pattern of pockets between associated groups of adjacent stems to provide a bulk locking ratio of at least 10 percent when engaged with an identical pattern at a zero degree engagement angle.

44. The touch fastener of claim 42 wherein the fastener element stems are integrally molded with and extend perpendicularly from the base.

45. The touch fastener of claim 42 wherein the fastener elements are arranged in a repeating pattern of row groupings, each row grouping having a three row band of fastener elements spaced apart from adjacent rows of fastener elements by a distance greater than row spacing within the band.

46. The touch fastener of claim 45 wherein the three row band consists of two outer rows of laterally aligned fastener elements and a middle row of fastener elements longitudinally offset from adjacent fastener elements of the outer rows.

47. The touch fastener of claim 42 wherein the fastener elements are arranged in a repeating pattern of four-element clusters, each cluster consisting of four fastener elements arranged at four corners of a four-sided polygonal area and spaced from adjacent clusters by a distance greater than a greatest side length of the polygonal area.

48. The touch fastener of claim 42 wherein the fastener elements are arranged in a repeating pattern of four-element clusters, each cluster consisting of four fastener elements arranged at four corners of a four-sided polygonal area, a clearance between a first pair of opposing fastener element heads at opposite corners of the area being greater than a nominal diameter of the fastener element heads, and a clearance between a second pair of opposing fastener element heads at opposite corners of the area being less than the nominal diameter of the fastener element heads.

49. The touch fastener of claim 42 wherein the array has an overall fastener element density of at least 200 fastener elements per square inch (31 fastener elements per square centimeter).

50. The touch fastener of claim 42 wherein the fastener element heads each have upper surfaces that are generally flat over an area covering their respective stems.

51. The touch fastener of claim 42 wherein the fastener elements are arranged to have a bulk overlap ratio, when engaged with an identical pattern at a zero degree engagement angle, of less than about 2.0 percent.

52. The touch fastener of claim 42 wherein the fastener elements are constructed and arranged to provide an engagement resistance ratio, when engaged with an identical pattern at a 45 degree engagement angle, of less than about 2.5.

53. A touch fastener product comprising a sheet-form base; and an array of fastener elements each having a stem extending from a broad side of the base to a distal head overhanging the base;

wherein the fastener elements are arranged in a repeating pattern of row groupings, each row grouping having a three row band of fastener elements spaced apart from adjacent rows of fastener elements by a distance greater than row spacing within the band.

54. The touch fastener of claim 53 wherein the fastener element stems are integrally molded with and extend perpendicularly from the base.

55. The touch fastener of claim 53 wherein the fastener elements are arranged to provide a bulk engagement ratio of at least 100 percent when engaged with an identical pattern at a zero degree engagement angle.

56. The touch fastener of claim 53 wherein the fastener elements are arranged to define a sufficient number and pattern of pockets between associated groups of adjacent stems to provide a bulk locking ratio of at least 10 percent when engaged with an identical pattern at a zero degree engagement angle.

57. The touch fastener of claim 53 wherein the three row band consists of two outer rows of laterally aligned fastener elements and a middle row of fastener elements longitudinally offset from adjacent fastener elements of the outer rows.

58. The touch fastener of claim 57 wherein each fastener element of the middle row is equidistant from two adjacent fastener elements of each of the outer rows.

59. The touch fastener of claim 57 wherein a clearance between opposing surfaces of adjacent fastener element heads along the middle row is less than a nominal lateral extent, measured along the middle row, of the fastener element heads.

60. The touch fastener of claim 57 wherein a clearance between opposing surfaces of adjacent fastener elements of the outer rows, measured across the three row band, is greater than a nominal lateral extent, measured along the middle row, of the fastener element heads.

61. The touch fastener of claim 60 wherein a clearance between opposing surfaces of adjacent fastener element heads along the middle row is less than a nominal lateral extent, measured along the middle row, of the fastener element heads.

62. The touch fastener of claim 53 wherein each row grouping comprises the three row band and at least one single row band of fastener elements.

63. The touch fastener of claim 62 wherein each row group consists of the three row band and a single row band of fastener elements spaced midway between the three row band of the grouping and a three row band of an adjacent grouping.

64. The touch fastener of claim 62 wherein each row group consists of the three row band and two single row bands of fastener elements separated by a distance greater than the row spacing within the three row band.

65. The touch fastener of claim 53 wherein the fastener element heads cover the base at a head density of between 20 and 35 percent.

66. The touch fastener of claim 53 wherein the array has an overall fastener element density of at least 200 fastener elements per square inch (31 fastener elements per square centimeter).

67. The touch fastener of claim 53 wherein the fastener elements are arranged to have a bulk overlap ratio, when engaged with an identical pattern at a zero degree engagement angle, of less than about 2.0 percent.

68. The touch fastener of claim 53 wherein the fastener elements are constructed and arranged to provide an engagement resistance ratio, when engaged with an identical pattern at a 45 degree engagement angle, of less than about 2.5.

69. The touch fastener of claim 53 wherein the fastener elements are arranged in an ordered pattern of straight rows.

70. A touch fastener product comprising a sheet-form base; and an array of fastener elements each having a stem extending from a broad side of the base to a distal head overhanging the base, the fastener elements arranged in an ordered pattern of straight rows;

wherein the fastener elements are constructed and arranged to provide an engagement resistance ratio, when engaged with an identical pattern at a 45 degree engagement angle, of less than about 2.5.

71. The touch fastener of claim 70 wherein the engagement resistance ratio is less than about 2.0.

72. The touch fastener of claim 70 wherein the fastener elements are constructed and arranged to provide an engagement resistance ratio, when engaged with an identical pattern at a 90 degree engagement angle, of less than about 1.8.

73. The touch fastener of claim 72 wherein the engagement resistance ratio is less than about 1.2.

* * * * *

UNITED STATES PATENT AND TRADEMARK OFFICE

CERTIFICATE OF CORRECTION

PATENT NO. : 6,687,962 B2
DATED : February 10, 2004
INVENTOR(S) : Mark A. Clarner et al.

It is certified that error appears in the above-identified patent and that said Letters Patent is hereby corrected as shown below:

Column 12,
Line 49, replace “die” with -- the --;

Column 13,
Line 7, replace “Opposite” with -- opposite --;
Line 31, replace “025” with -- 0.25 --;
Line 62, replace “loss” with -- less --.

Signed and Sealed this

Twenty-second Day of June, 2004

JON W. DUDAS
*Acting Director of the United States Patent and Trademark Office*